US005138916A

United States Patent [19]

Sato et al.

[11] Patent Number: 5,138,916

[45] Date of Patent: Aug. 18, 1992

[54] POWER OPERATED SCREWDRIVER

[75] Inventors: Yuichi Sato; Atsushi Nakagawa, both of Katsuta, Japan

[73] Assignee: Hitachi Koki Company Limited, Tokyo, Japan

[21] Appl. No.: 742,243

[22] Filed: Aug. 8, 1991

[30] Foreign Application Priority Data

Dec. 1, 1989 [JP] Japan ..... 1-139973[U]

[51] Int. Cl.[5] ..... B25B 23/157

[52] U.S. Cl. ..... 81/474; 81/475

[58] Field of Search ..... 81/472–476

[56] References Cited

U.S. PATENT DOCUMENTS

| | | | |
|---|---|---|---|
| 1,744,976 | 1/1930 | Levedahl | 81/475 X |
| 2,690,090 | 9/1954 | Pedersen | 81/475 |
| 4,630,512 | 12/1986 | Dürr | 81/475 |
| 4,655,103 | 4/1987 | Schreiber et al. . | |
| 4,947,714 | 8/1990 | Fluri | 81/475 |

FOREIGN PATENT DOCUMENTS 61-219581 9/1986 Japan .

*Primary Examiner*—D. S. Meislin

*Attorney, Agent, or Firm*—Lowe, Price, LeBlanc & Becker

[57] ABSTRACT

A power operated screwdriver including a support shaft firmly secured to a motor housing, a gear driven by a motor shaft and rotatably mounted on the support shaft, a main spindle slidably mounted on the supported shaft and holding a detachable drill bit, and an intermediate clutch disc slidably mounted on the support shaft between the gear and the main spindle. The gear and the intermediate clutch disc are selectively connected and separated by a first clutch, while the intermediate clutch disc and the main spindle are always connected together by a second clutch. A compression coil spring acts between the support shaft and the intermediate clutch disc and urges the intermediate clutch disc toward the main spindle to disengage the first clutch. With this construction, the a rotational driving force of the gear is transmitted to the main spindle via the intermediate clutch disc and first and second clutches only when the screwdriver is performing a screw-driving operation. During a no-load rotation of the gear, the main spindle is separated from the gear so that the driver bit can be fitted in a groove in the head of a screw stably and reliably.

2 Claims, 2 Drawing Sheets

POWER OPERATED SCREWDRIVER

BACKGROUND OF THE INVENTION

1. Field of the Invention

The present invention relates to a power operated screwdriver.

2. Description of the Prior Art

A typical example of the power operated screwdrivers of the type concerned is disclosed in U.S. Pat. No. 4,655,103. The disclosed screwdriver includes a drive shaft on which a gear, an central disc and a clutch disc are mounted with a compression coil spring disposed between the gear and the central disc. The gear has trapezoidal first cams engageable with to trapezoidal second cams formed on one surface of the central disc. The opposite surface of the central disc has first jaws engageable with second jaws on the clutch disc. When the screwdriver completes a screw-driving operation, the gear and the central disc are separated by the force of the compression coil spring, whereas the central disc and the clutch disc are connected together while the first and second jaws are held out of direct engagement with each other by the force of the compression coil spring.

Since the drive shaft is rotatably mounted in a body of the screwdriver and since the gear is slidably mounted on the drive shaft, rotation of the gear causes the drive shaft to rotate together with the gear due to a friction acting between the inside surface of a central hole in the gear and the outside surface of the drive shaft. Furthermore, the compression coil spring acting directly between the gear and the central disc tends to interconnect the gear and the central disc under the resiliency of the compression coil spring. The rotational driving force of the gear is, therefore, transmitted to the drive shaft via the clutch disc with the result that the drive shaft is rotated together with the gear.

Thus, in the conventional screwdriver, the drive shaft rotates during no-load rotation of the gear before it is axially displaced to positively engage the first and second jaws and also the first and second cams for transmitting the rotational driving force of the gear to the drive shaft to perform a screw-driving operation. When screws are to be driven successively one at a time by the conventional screwdriver, the gear is continuously rotated by a drive motor. Consequently, the co-rotation of the drive shaft and the gear during the no-load operation makes it difficult to fit the driver bit into a groove in the head of each screw reliably and stably. The efficiency of screw-driving operation of the conventional screwdriver is considerably low.

SUMMARY OF THE INVENTION

With the foregoing drawbacks of the prior art in view, it is an object of the present invention to provide a power operated screwdriver which is capable of performing a continuous screw-driving operation efficiently without causing the dragging or co-rotation of a driver bit with a drive gear while the gear is rotated continuously during a no-load operation of the screwdriver.

According to the invention, there is provided a power operated screwdriver which comprises a support shaft non-rotatably mounted in a body of the screwdriver and firmly secured at an end to a motor housing of the body, a gear rotatably mounted on the support shaft and driven by a motor shaft, a main spindle rotatably and axially displaceably mounted on the support shaft, and an intermediate clutch disc rotatably and axially displaceably mounted on the support shaft between the gear and the main spindle. A first clutch selectively engages and disengages the gear and the intermediate clutch disc, while a second clutch continuously engages the intermediate clutch disc and the main spindle. A spring acts between the support shaft and the intermediate clutch disc and urges the intermediate clutch disc toward the main spindle to normally disengage the first clutch. A driver bit is detachably connected to a front end of the main spindle and movable relative to the body to displace the main spindle and the intermediate clutch disc along the support shaft toward the gear for engaging the first clutch only when the screwdriver is operating under a loaded condition.

With this construction, the main spindle is prevented from rotating together with the gear while the gear is continuously rotated during a no-load operation of the screwdriver. The driver bit connected to the main spindle can, therefore, be fitted in a groove in the head of a screw stably and reliably, so that the screw-driving operation can be performed efficiently and continuously.

The support shaft may be secured to the motor housing via a washer in which instance the washer is non-circular and firmly fitted in a non-circular recess in the motor housing, and the end of the support shaft has a non-circular cross-section and fitted in a non-circular central hole in the washer.

The above and other objects, features and advantages of the present invention will become more apparent from the following description when making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
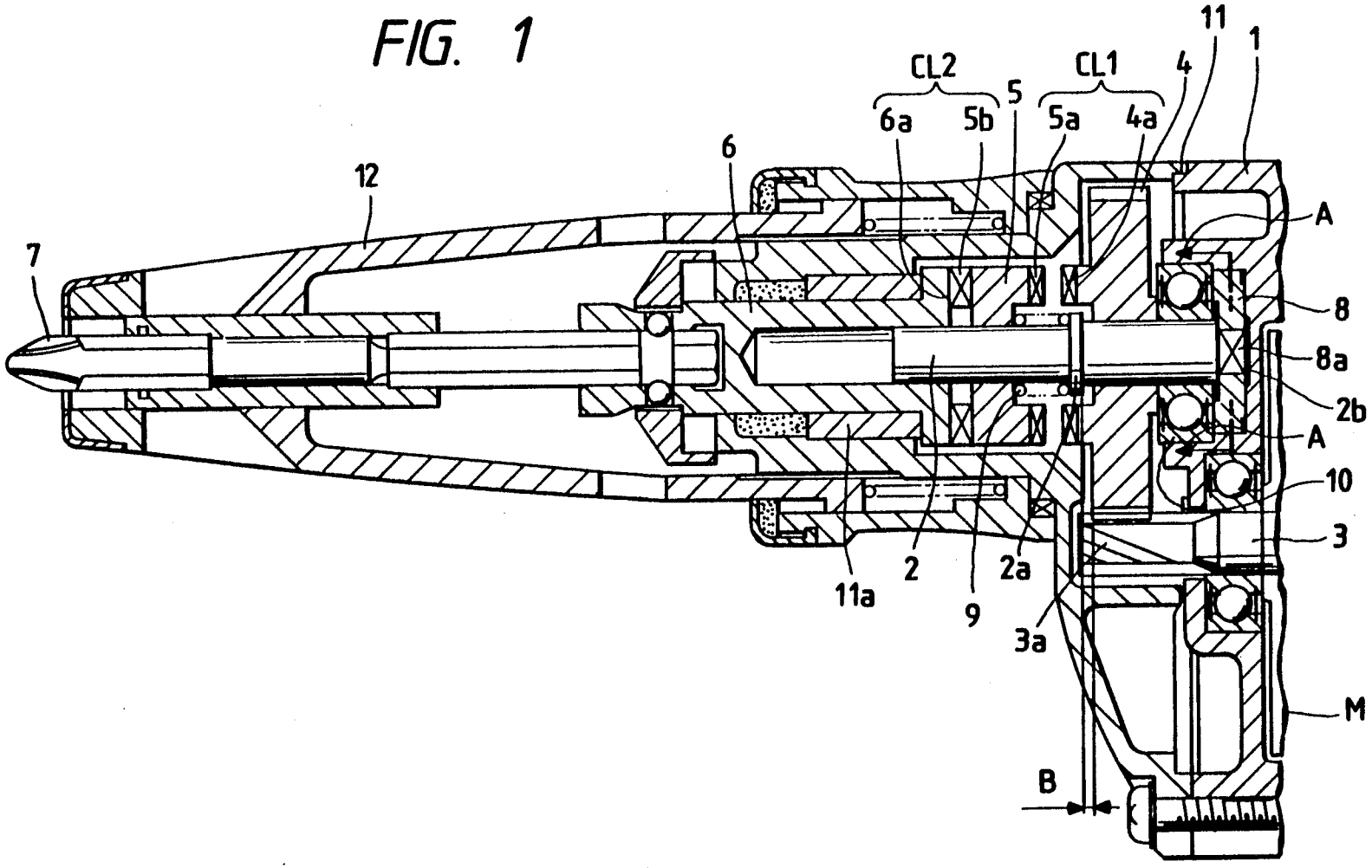
FIG. 1 is a fragmentary longitudinal cross-sectional view of a power operated screwdriver according to the present invention.

The present invention will be described in greater detail with reference to a certain preferred embodiment shown in the accompanying drawings in which like reference characters designate like or corresponding parts throughout the several views.

As shown in FIG. 1, a power operated screwdriver according to the present invention generally comprises a body having a motor housing 1, a support shaft 2 connected at its one end to the motor housing 1, a motor M received in the motor housing 1 and having an output shaft 3 (hereinafter referred to as "motor shaft") extending parallel to the support shaft 2 and transmitting a rotational driving force of the motor M to a gear 4 mounted on the support shaft 2, an intermediate circular clutch member or disc 5 to which the rotational driving force can be transmitted from the gear 4, a main spindle 6, and a driver bit 7 detachably connected to a front end of the main spindle 6. The intermediate clutch disc 5 and the main spindle 6 are slidably mounted on the support shaft 2 and, hence, they are rotatable on, and axially displaceable along, the support shaft 2. The gear 4 and the intermediate clutch disc 5 have on their confronting surfaces at least one mating pair of jaws or teeth 4*a* and 5*a* cooperative to form a first clutch CL1. Similarly, the intermediate clutch disc 5 and the main spindle 6 have on their confronting surfaces at least one mating pair of jaws or teeth 5*b* and 6*a* cooperative to form a second clutch CL2. The first and second clutches CL1 and CL2 cooperate to selectively transmit a rotary motion of the gear 4 to the main spindle 6 in response to the axial displacement of the main spindle 6.

The support shaft 2 is secured to the motor housing 1 via a washer 8. The gear 4 is rotatably mounted on the support shaft 2. The support shaft 2 has an annular flange 2*a* at a proper position for retaining one end of a compression coil spring 9 disposed around the support shaft 2. The compression coil spring 9 acts between the annular flange 2*a* and the intermediate clutch disc 5 and urges the intermediate clutch disc 5 toward the main spindle 6. With the compression coil spring 9 thus disposed, the second clutch CL2 formed jointly by the jaw 5*b* on the intermediate clutch disc 5 and the jaw 6*a* on the main spindle 6 is always engaged, while the first clutch CL1 formed jointly by the jaw 4*a* on the gear 4 and the jaw 5*a* on the intermediate clutch disc 5 is disengaged during a no-load condition of the screwdriver even when the gear 4 is continuously rotated by the motor shaft 3. The first clutch CL1 engages when the screwdriver is performing a screw-driving operation under a loaded condition. With this construction, the gear 4 rotating continuously cannot drag the main spindle 6 into co-rotation therewith during the no-load condition. The driver bit 7 attached to the main spindle 6 is, therefore, prevented from dragging or rotating during a no-load operation of the screwdriver. As a result, it is possible to fit the driver bit 7 stably and reliably into a groove in the head of each screw when a number of screws are driven successively one at a time to a workpiece while the motor M is continuously energized. Thus, the screw-driving operation can be performed continuously and efficiently.

The support shaft 2 is non-rotatably mounted in the body of the screwdriver as it is secured at one end 2*b* to the motor housing 1. The gear 4 rotatably mounted on the support shaft 2 meshes with a pinion 3*a* on the motor shaft 3 to reduce a rotational speed of the motor shaft 3. The washer 8 supporting one end 2*b* of the support shaft 2 on the motor housing 1 retains thereon an outer race of a thrust ball bearing 10 whose inner race is held in contact with the gear 4 rotatably mounted on the support shaft 2. The gear 4, the intermediate clutch disc 5, the compression coil spring 9 and the main spindle 6 are enclosed with a gear cover 11 secured to the motor housing 1 by means of a plurality of screws (one shown in FIG. 1 but not designated). The driver bit 7 detachably connected to the main spindle 6 is substantially enclosed in an elongate tubular locator 12 threaded with a front end of the gear cover 11. The locator 12 is axially displaceable relative to the gear cover 11 so as to adjust the amount of projection of the driver bit 7 from the front end of the locator 12.

Figure 2:
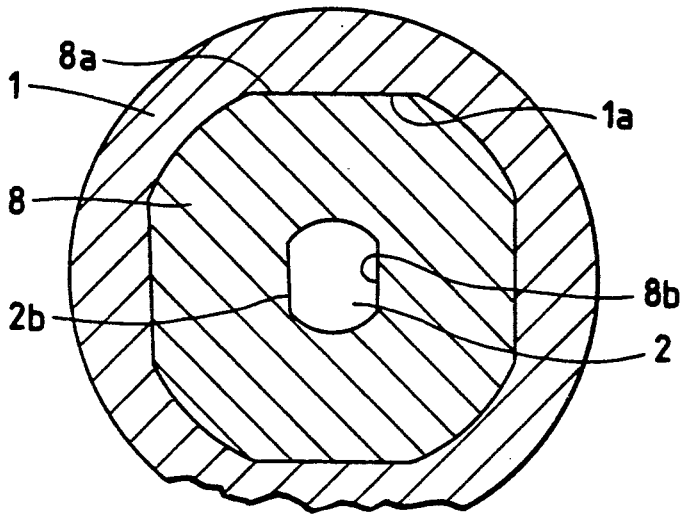
FIG. 2 is a cross-sectional view taken along the line A—A of FIG. 1.

As shown in FIG. 2, the washer 8 has a non-circular shape complementary in contour to the shape of a non-circular recess 1*a* in the motor housing 1 and is fitted in the non-circular recess 1*a* so that the washer 8 is non-rotatable relative to the motor housing 1. The end 2*b* of the support shaft 2 has a non-circular cross-sectional shape which is complementary in contour to the shape of a non-circular central hole 8*b* in the washer 8. The non-circular end 2*b* of the support shaft 2 is fitted in the non-circular central hole 8*b* in the washer 8 so that the support shaft 2 is non-rotatable relative to the washer 8 but detachable from the washer 8 by being displaced in the axial direction thereof. With this arrangement, the support shaft 2 assembled in the motor housing 1 is non-rotatable relative to the motor housing 1.

Referring back to FIG. 1, the annular flange 2*a* of the support shaft 2 is slightly separated from the gear 4 by a space or clearance B so as to avoid generation of heat which wound otherwise be caused by frictional engagement between the annular flange 2*a* and the gear 4. Since the support shaft 2 is non-rotatable, the space B may be omitted in terms of operation of the invention.

Figure 3:
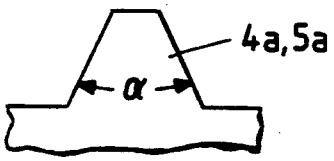
FIG. 3 is a developmental view showing the shape of jaws or teeth of a first clutch formed jointly by an intermediate clutch disc and a gear.

As shown in FIG. 3, the jaw 4*a* of the gear 4 which consists of one part of the first clutch CL1 and the jaw 5 of the intermediate clutch disc 5 which consists of the other part of the first clutch CL1 have a trapezoidal shape and taper at an angle $\alpha$ of 55 to 65 degrees.

As described above, owing to the compression coil spring 9 acting between the annular flange 2*a* of the support shaft 2 and the intermediate clutch disc 5, the intermediate clutch disc 5 is forced toward the driver bit 7, while the support shaft 2 is forced against an end face of the washer 8. As a consequence, the jaw 4*a* on the gear 4 and the jaw 5*a* on the intermediate clutch disc 5 are normally disengaged from each other.

Figure 4:
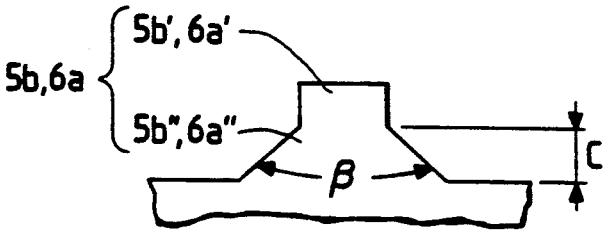
FIG. 4 is a developmental view showing the shape of jaws or teeth of a second clutch formed jointly by the intermediate clutch disc and a main spindle.

As shown in FIG. 4, the jaw 5*b* of the intermediate clutch disc 5 which consists of one part of the second clutch CL2 and the jaw 6*a* of the main spindle 6 which consists of the other part of the second clutch CL2 have a polygonal shape. Each of the polygonal jaws 5*b*, 6*a* is composed of a square head 5*b*', 6*a*' and a trapezoidal base 5*b*'', 6*a*'' integral with the head 5*b*', 6*a*'' and tapering toward the head 5*b*', 6*a*' at an angle $\beta$ of 125 to 135 degrees. The trapezoidal base 5*b*'', 6*a*'' has a height C. The jaws 5*b*, 6*a* are always held in engagement with each other under the force of the compression coil spring 9, as shown in FIG. 1.

The main spindle 6 is slidably received in a sleeve bearing 11*a* press-fitted in a front end of the gear cover 11 and hence is rotatable and axially displaceable relative to the support shaft 2 and the gear cover 11. The main spindle 6 is normally urged leftward in FIG. 1 by the compression coil spring 9 until a flanged inner end of the main spindle 6 abuts against an inner end of the sleeve bearing 11*a*.

The power operated screwdriver of the foregoing construction operates as follows.

When a trigger switch (not shown) of the screwdriver is turned on, the motor shaft 3 is rotated to revolve the gear 4 which is held in mesh with the pinion 3*a* of the motor shaft 3. In this instance, the rotational driving force is not transmitted from the gear 4 to the support shaft 2 as the support shaft 2 is non-rotatably mounted in the motor housing 1. In addition, the compression coil spring 9 urges the intermediate clutch disc 5 leftward in FIG. 1 to disengage the first clutch CL1 so that the rotational driving force of the gear 4 is not transmitted to the intermediate clutch disc 5. Thus, during a no-load rotation of the gear, a power transmission line extending from the gear 4 to the main spindle 6 is disconnected with the result that the main spindle 6 is not dragged into co-rotation with the gear 4.

While the trigger switch is being kept in an activated condition, the driver bit 7 is fitted in a groove in the head of a screw, not shown, set on a position of a workpiece, not shown. In this instance, however, since the main spindle 6 is not rotated, the driver bit 7 can be fitted with the screw head stably and reliably. Then, the body of the screwdriver is manually forced or thrust forwardly toward the workpiece while the trigger switch is continuously turned on. The forward movement of the body of the screwdriver causes the main spindle 6 and the intermediate clutch disc 5 to move toward the gear 4 against the force of the compression coil spring 9, thereby engaging the jaws 4*a* and 5*a* of the first clutch CL1. Now, both of the first and second clutches CL1 and CL2 are engaged, so that the rotational driving force of the motor shaft 3 is transmitted to the main spindle 6 via the gear 4 and the intermediate clutch disc 5. The driver bit 7 coupled with the main spindle 6 is thus rotated to drive the screw into the workpiece for fastening the workpiece to an article, not shown. Thus, one cycle of the screw-driving operation is completed.

At a first or initial stage of the screw-driving operation, the main spindle 6 compresses the compression coil spring 9 via the intermediate clutch disc 5, a flank surface of the jaw 5*a* engages a flank surface of the jaw 4*a* to connect the gear 4 and the main spindle 6, thereby rotating the main spindle 6. Upon rotation of the main spindle 6, the square head 6*a'* of the jaw 6*a* slides down along a sloped flank surface of the trapezoidal base 5*b''* of the jaw 5*b* and then meshes with the square head 5*b'* of the jaw 5*b*. Thus, the rotational driving force of the gear 4 is transmitted to the main spindle 6 via the intermediate clutch disc 5, thereby turning the driver bit 7 to tighten the screw.

When the screw being tighten reaches to a predetermined position, the jaws 4*a* and 5*a* of the first clutch CL1 are forced to slide along their mating flank surfaces in opposite directions. In this instance, the movement of the intermediate clutch disc 5 is assisted by the force of the compression coil spring 9, so that the first clutch CL1 is disengaged and hence the main spindle 6 is separated from the gear 4 via the intermediate clutch disc 5.

As the intermediate clutch disc 5 is forced toward the main spindle 6 under the force of the compression coil spring 9, the square head 5*b'* on the jaw 5*b* slides down along the sloped flank surface of the base 6*a''* of the jaw 6*a* until it engages with the inner end face of the main spindle 6.

After the screw is tightly driven, the jaws 4*a* and 5*a* of the first clutch CL1 are spaced by a distance equal to the height C of the trapezoidal bases 5*b''*, 6*a''* of the jaws 5*b*, 6*a* and, hence, they do not generate unpleasant shock noise and are free from abrasive wear.

As appears clear from the foregoing description, a support shaft on which a gear is mounted is firmly secured to a motor housing. In addition, the force of a compression coil spring does not act on the gear. With this arrangement, a friction which is created during rotation of the gear is not transmitted to a main spindle. Thus, the main spindle is prevented from rotating during a no-load operation in which the gear is rotated continuously. A driver bit detachably connected to the main spindle can be fitted in a groove in the head of a screw reliably and stably with the result that a screw-driving operation is performed efficiently.

Obviously, various minor changes and modifications of the present invention are possible in the light of the above teaching. It is therefore to be understood that within the scope of the appended claims the invention may be practiced otherwise than as specifically described.

What is claimed is:

1. A power operated screwdriver comprising:

(a) a body having a motor housing;

(b) a support shaft non-rotatably mounted in said body and firmly secured at an end to said motor housing;

(c) a gear rotatably mounted on said support shaft and driven by a motor shaft;

(d) a main spindle rotatably and axially displaceably mounted on said support shaft;

(e) an intermediate clutch disc rotatably and axially displaceably mounted on said support shaft and disposed between said gear and said main spindle;

(f) a first clutch for selectively engaging and disengaging said gear and said intermediate clutch disc;

(g) a second clutch continuously engaging said intermediate clutch disc and said main spindle;

(h) a spring acting between said support shaft and said intermediate clutch disc to urge said intermediate clutch disc toward said main spindle to disengage said first clutch; and (i) a driver bit detachably connected to a front end of said main spindle and movable relative to said body to displace said main spindle and said intermediate clutch disc toward said gear along said support shaft to connect said first clutch only when said screwdriver is operating under a loaded condition.

2. A power operated screwdriver according to claim 1 wherein said motor housing has a non-circular recess, further including a non-circular washer complementary in contour to the shape of said non-circular recess and fitted in said non-circular recess, said washer having a non-circular central hole, said one end of said support shaft having a non-circular cross-section and being fitted in said non-circular central hole of said washer.

* * * * *